United States Patent [19]

Jonasson

[11] 4,329,935

[45] May 18, 1982

[54] ARRANGEMENT IN MOUNTING SUPPLEMENTARY DECKS IN SHIPS

[75] Inventor: Bo E. Jonasson, Västra Frölunda, Sweden

[73] Assignee: von Tell AB, Molndal, Sweden

[21] Appl. No.: 160,192

[22] Filed: Jun. 17, 1980

[30] Foreign Application Priority Data

Aug. 20, 1979 [SE] Sweden ..... 7906918

[51] Int. Cl.[3] ..... B63B 25/18

[52] U.S. Cl. ..... 114/72; 114/85

[58] Field of Search ..... 114/72, 76, 78, 73, 114/75, 83, 85, 88; 105/370, 375; 410/14, 24, 25, 82, 83; 108/51.1, 64, 114; 52/263, 695

[56] References Cited

U.S. PATENT DOCUMENTS

| | | | |
|---|---|---|---|
| 1,049,685 | 1/1913 | Donnelly | 114/85 |
| 2,676,420 | 4/1954 | Berg | 108/114 |
| 4,074,488 | 2/1978 | Ray | 52/263 |
| 4,082,052 | 4/1978 | Looks | 114/75 |

FOREIGN PATENT DOCUMENTS

| | | | |
|---|---|---|---|
| 522950 | 10/1953 | France | 114/85 |

*Primary Examiner*—Trygve M. Blix
*Assistant Examiner*—Stephen P. Avila
*Attorney, Agent, or Firm*—Harness, Dickey & Pierce

[57] ABSTRACT

A supplementary deck which is easy to mount and dismantle between the existing decks in ships of the kind intended to carry loading containers and wherein at least one of the decks is provided with apertures, arranged in groups of four, which aperture groups are distributed equally pitched over the deck to receive locking bolts of the kind known as twist locks which serve to removably secure the loading containers to the deck. The supplementary deck comprises a number of wall sections each one of which is formed at the top and at the bottom with apertures, arranged in groups of four for reception therein of locking bolts and they are disposed in the same pitch relationship as the apertures formed in the stationary deck. The wall sections are arranged to be connected in pairs at their top to rectangular loading container platforms by means of the locking bolts. The platforms are provided at each one of the lower corners with an aperture for passage therethrough of a locking bolt. These apertures are arranged in the same pitch relationship as the corresponding apertures in the stationary deck.

5 Claims, 12 Drawing Figures

Fig. 6
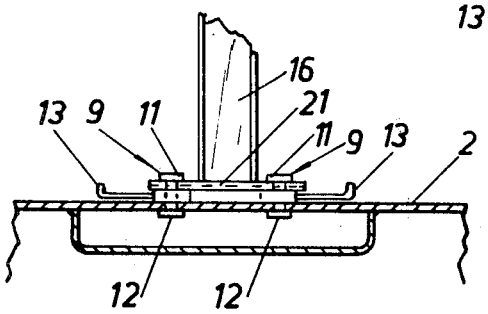
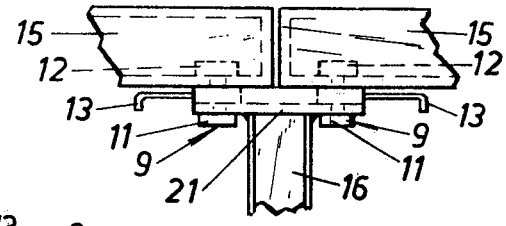
Fig. 7
Fig. 8
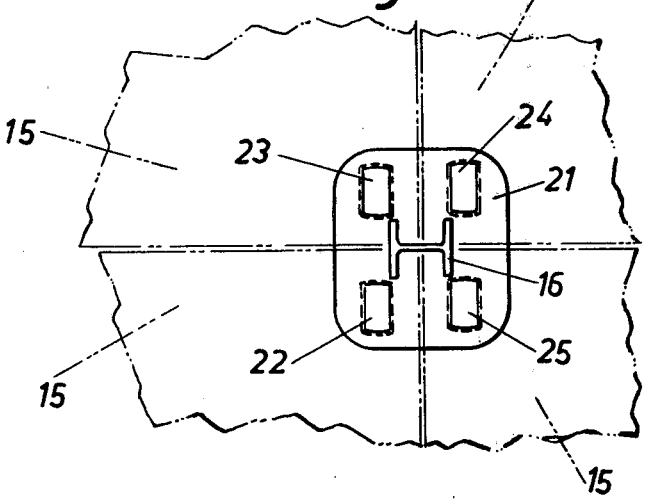
Fig. 10
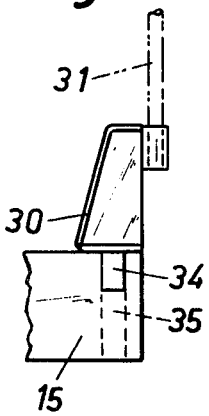
Fig. 9
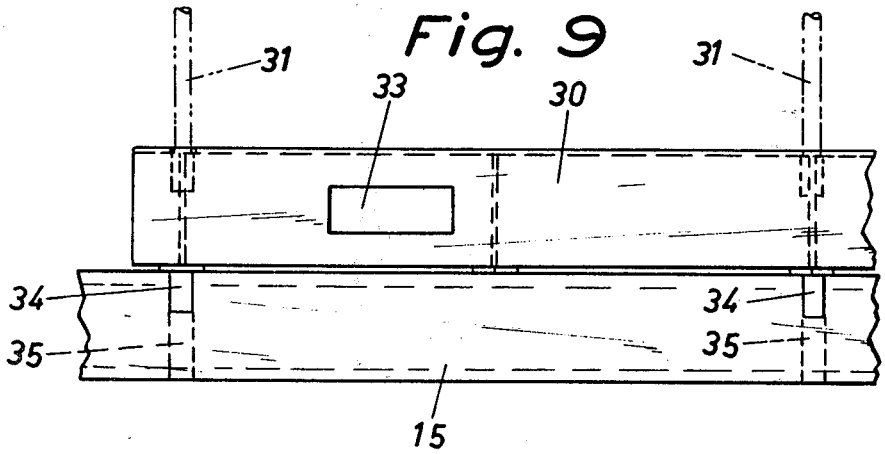

ARRANGEMENT IN MOUNTING SUPPLEMENTARY DECKS IN SHIPS

BACKGROUND OF THE INVENTION

It is already known to mount supplementary decks between the existing decks in ships in order to make better use of the available space in ship hulls for transport of goods of the kind that is not readily stackable, such as e.g. cars. Such supplementary decks must be easy to erect and dismantle, according to need.

The purpose of the subject invention is precisely to provide an arrangement according to which supplementary decks may be conveniently mounted between the existing decks in ships of the kind which are built to carry loading containers and wherein in the existing decks are formed apertures, arranged in groups of four, which aperture groups are distributed over the deck equally pitched to receive locking bolts of the kind known as twist locks which serve to removably secure the loading containers to the deck.

SUMMARY OF THE INVENTION

The arrangement in accordance with the invention comprises a number of wall sections each one of which is equipped at the top as well as at the bottom with horizontal flanges in which are formed apertures for passage therethrough of the locking bolts, said apertures being arranged in groups of four and disposed in the same pitch relationship as the apertures formed in the stationary deck. The upper portions of the wall sections are arranged to be connected in pairs to rectangular loading container platforms by means of the locking bolts, said rectangular container platforms having a width which is substantially equal to that of the wall sections and being provided at each one of their lower corners with apertures for passage therethrough of a locking bolt, said apertures arranged in the same pitch relationship as the corresponding apertures formed in the wall sections and in the stationary deck.

Owing to this arrangement, a modular system is provided which highly facilitates mounting of the supplementary deck since because both ends of the wall sections are identical it does not matter which end is positioned upwards and because despite the light structure of the wall section, a strong joint is obtained.

BRIEF DESCRIPTION OF THE DRAWINGS

The invention will be described in closer detail in the following with reference to the accompanying drawings, wherein

FIG. 6 is a cross-sectional view through one of the ship's decks at one of the points of interconnection between a wall section and the deck.

FIG. 7 is a lateral view of the upper end of a wall section showing two container platforms attached thereto.

FIG. 8 is a plan view of a point of interconnection, showing the interconnection between four container platforms, positioned adjacent one another.

FIG. 9 is a lateral view of a driving-off security rail.

FIG. 10 is an end view of said rail.

DETAILED DESCRIPTION OF A PREFERRED EMBODIMENT

Figure 1:
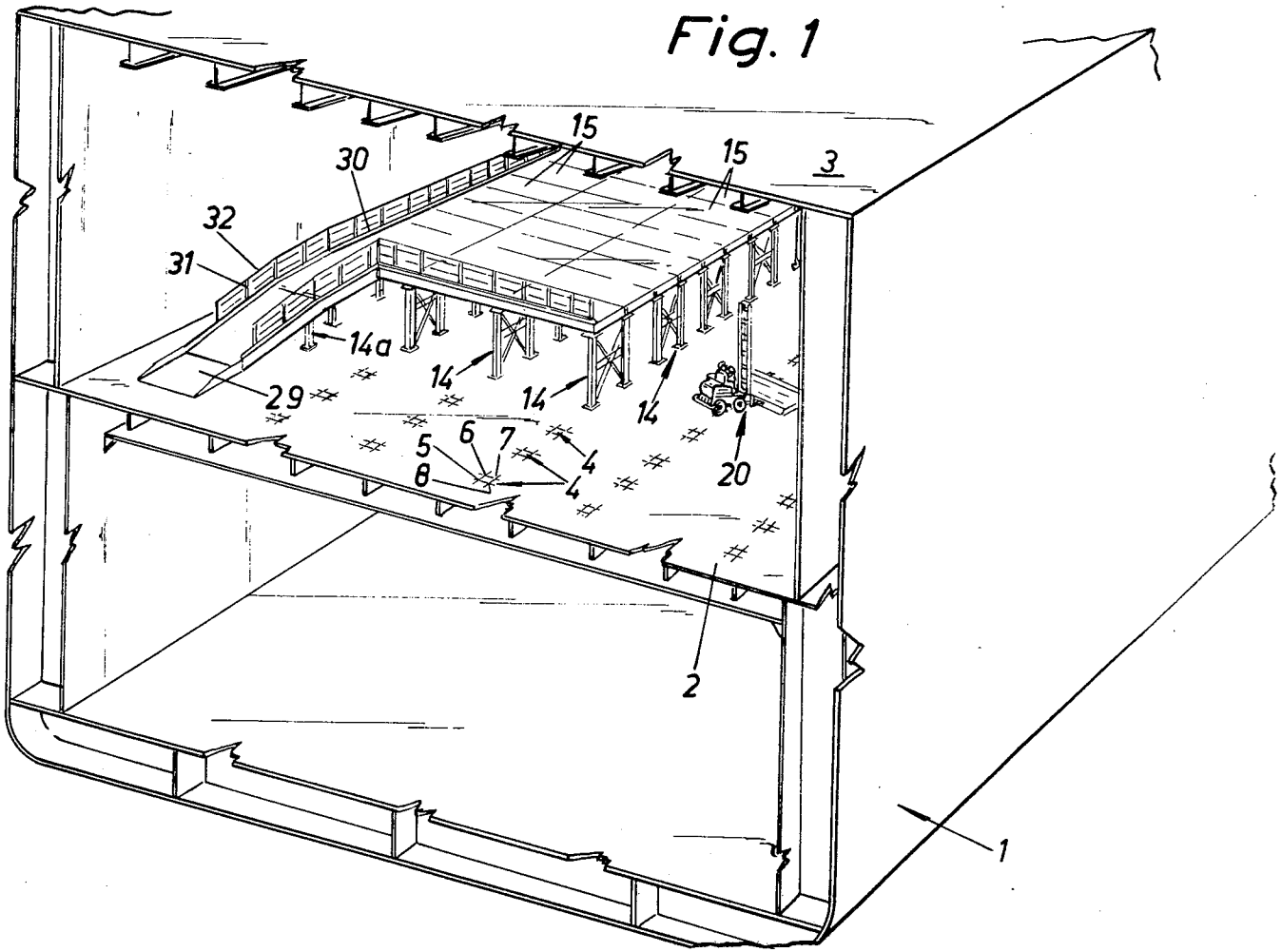
FIG. 1 is a cross-sectional view through a ship showing a supplementary deck in accordance with the invention in a perspective view obliquely from above.
Figure 2:
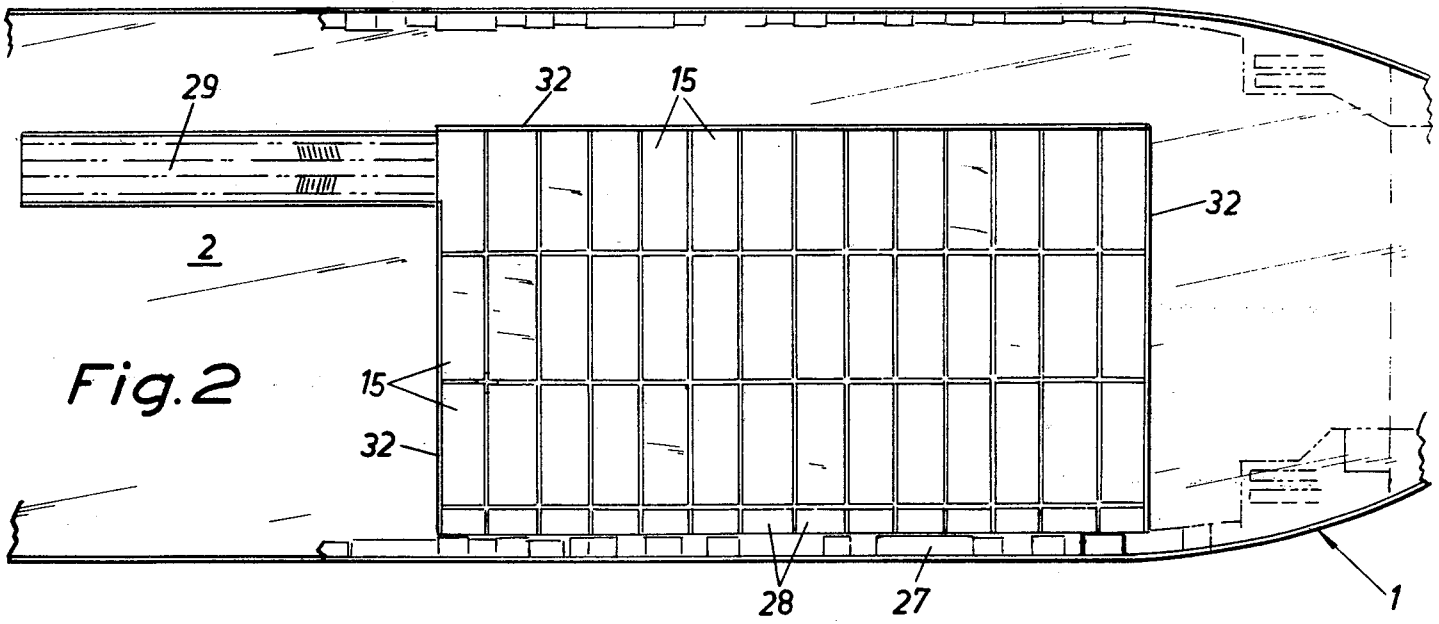
FIG. 2 is a plan view of the supplementary deck.
Figure 3:
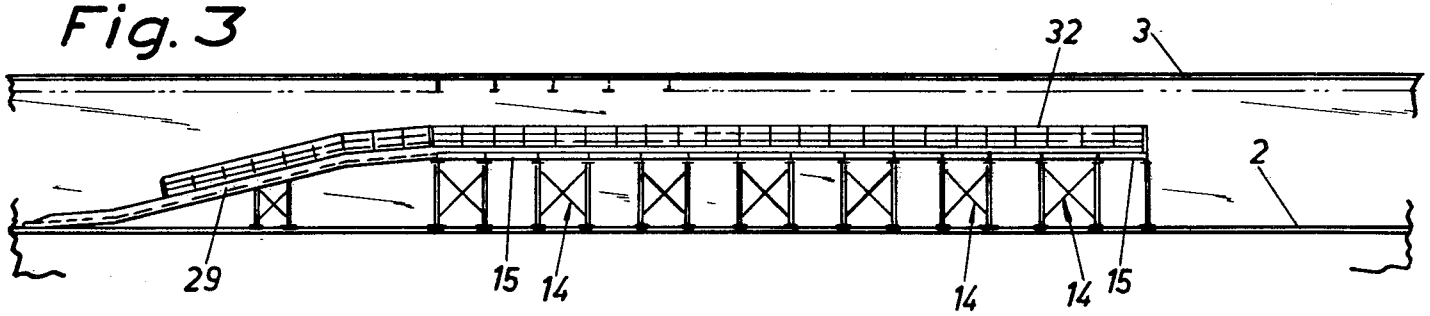
FIG. 3 is a lateral view of the supplementary deck.
Figure 11:
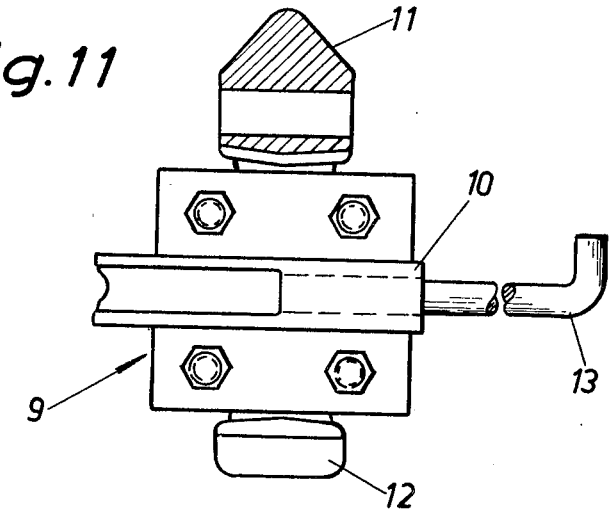
FIG. 11 shows on an enlarged scale a lateral view of a locking bolt of the kind known as a twist lock.
Figure 12:
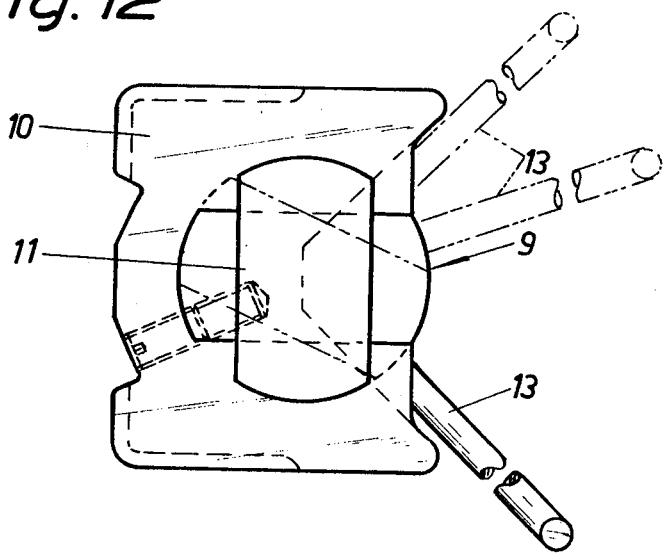
FIG. 12 is a lateral view of said lock.

FIG. 1 illustrates in a cross-sectional view and FIG. 3 in a longitudinal sectional view a ship 1 the main deck of which is designated by 2 and the upper deck by 3. In the main deck 2 are made groups 4 of apertures arranged in rows extending in the lengthwise direction of the ship. Each aperture group comprises four oblong apertures 5, 6, 7, 8, the pitch between the groups being equal as well as the pitch between the apertures in each group. Each one of the apertures 5–8 is intended to receive a locking bolt 9 (FIGS. 11 and 12) of the kind known as a twist lock which comprises an intermediate portion 10, an upper bolt portion 11 which may be turned in the intermediate portion, and a lower bolt portion 12 which also may be turned in the intermediate portion. Both bolt portions may be turned by means of an operating lever 13. The bolts 9 are arranged to secure loading containers (not shown) to the main deck 2 by insertion of the lower bolt portion 12 each into its respective one of apertures 5–8 and by insertion of the upper bolt portion 11 into one of the apertures formed in one of the corner boxes of the associated container. The bolt portions 11, 12 are then turned to locking position with the aid of the operating lever 13. In this position, the longer extension of the bolts is at right angles to the longer extension of the apertures 5–8.

The normal equipment of ships thus comprises a large number of locking bolts 9 of the kind referred to. These bolts are made use of when a supplementary deck structure according to the teachings of the subject invention is to be erected on the main deck 2. The supplementary deck likewise comprises a number of wall sections 14 as well as a number of loading container platforms 15 the bottom dimensions of which coincide with those of the loading containers proper and which platforms are provided at their corners with oblong apertures in which to receive the upper portion 11 of the locking bolts 9.

Each wall section 14 comprises two corner posts 16 which are interconnected by diagonal struts 17 and by a cross bar 18 which is positioned above the centre of gravity of the wall section. The cross bar 18 is formed with two openings 19 through which may pass the lifting legs of a fork lift truck 20, whereby the wall section, suspended in the truck lifting legs in a vertical position may be lifted and moved. Each corner post 16 is formed at its top as well as at its bottom with a flange 21. Four oblong apertures 22, 23, 24, 25 are formed in each flange, in the same pitch relationship as the apertures 5–8 in the main deck 2. Also, the pitch between the aperture groups in this deck agrees with the pitch between the aperture groups in the wall sections.

Figure 4:
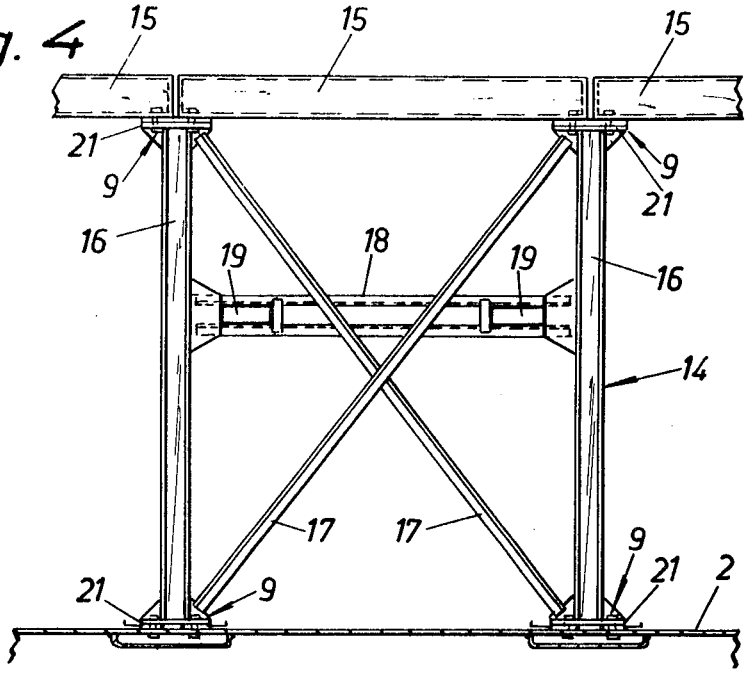
FIG. 4 illustrates on an enlarged scale a front view of one of the wall sections of the supplementary deck.

The erection of the supplementary deck in accordance with the invention is effected in the following manner. Into each one of the apertures 5–8 formed in the main deck 2 is inserted a locking bolt 9 with its intermediate portion 10 resting on the deck while the lower bolt portion 12 is locked to the deck and the upper bolt portion 11 extends upwards from the deck. A fork lift truck 20, holding a wall section 14 in a vertical position, positions the lower flanges 21 of the wall section on top of two of the aperture groups 4 (see FIG. 1) such that the upstanding upper portions 11 of the locking bolts in these apertures penetrate into the apertures 22–25 in the wall section flanges. The bolt portions 11 are turned into locking position with the aid of the operating levers 13 while the wall section 14 is kept steadily in vertical position on the deck. The fork lift truck 20 delivers a second wall section 14 and positions it opposite the first wall section but in the neighbouring row of aperture groups 4. Attachment of the second wall section is effected in the same manner as in the case of the first one. When a number of wall sections have been positioned in this manner in pairs opposite one another and the apertures formed in their upper flanges 21 have received locking bolts 9 therein (FIG. 9), a container platform 15 is supplied by means of the fork lift truck 20 (also the platforms 15 should be provided with openings allowing the platforms to be lifted by the lifting legs of a fork lift truck) which is driven into the gap between the walls 14, holding the platform in a horizontal position, with the lifting legs at a sufficiently high level to allow free passage of the platform above the walls 14. The platform 15 is lowered into position in alignment with a pair of wall sections 14, care being taken that one of the locking bolts 9 in each aperture group in the flanges 21 engages in the corresponding aperture in the corner of the platform. The lever 13 is operated to lock the platform to the two wall sections 14 in the manner described above. It should be noted that as indicated in FIGS. 4 and 8 the platform will rest on only a fourth of each flange 21. The erection of the deck is continued in the manner indicated, with one platform being positioned adjacent the other.

Figure 5:
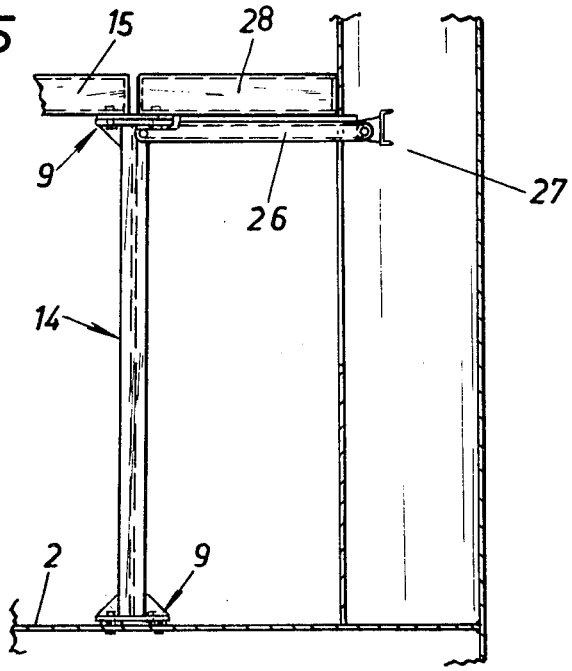
FIG. 5 is a lateral view of one of the wall sections which is joined to the shell plating of the ship by means of a strut.

To obtain the desired stability laterally the supplementary deck is provided with horizontal struts 26 (FIG. 5) which are connected to the steel plating 27 of the ship. On these struts rest fill-in slabs 28.

To allow cars to be driven onto the supplementary deck the latter is provided with a drive ramp 29 consisting of container platforms 15 which rest on shorter wall sections 14*a* (FIG. 1).

The supplementary deck also comprises a drive-off safety rail consisting of lengthwise sheet metal beams 30 which are provided with apertures 33 allowing passage-through of the lifting legs of fork lift trucks 20. In addition, the beams 30 are provided with downwardly directed pins 34 matching vertical apertures formed in the container platforms 15.

The assembly described in the aforegoing may be carried out in a very convenient manner, if need be by one man alone. The dismantling is carried out in the same easy manner.

The embodiment as shown and described is to be regarded as one example only. The wall sections 14 and also the locking bolts 9 may be constructed in a different manner from that illustrated in the drawings.

What I claim is:

1. An improved device in mounting supplementary decks between existing decks in ships of the kind built for loading container transport, at least one of the existing decks of said ship formed with apertures, arranged in groups of four and positioned in equal pitch relationship, said apertures adapted to receive locking bolts therein of the kind known as twist locks, said bolts serving to removably secure the loading containers to said deck, the improvement comprising a number of wall sections, horizontal flanges arranged at the top as well as at the bottom of each wall section, apertures formed in said flanges for passage therethrough of said locking bolts, said apertures being arranged in groups of four and disposed in the same pitch relationship as the apertures formed in said stationary deck, rectangular loading container platforms, said platforms having a width which is substantially equal to that of said wall sections, apertures formed at each one of the lower corners of said container platforms, said apertures intended to receive locking bolts therein and arranged in the same pitch relationship as the corresponding apertures formed in said wall sections and in said stationary deck, the upper portions of said wall sections being arranged to be connected in pairs to said rectangular loading container platforms by means of said locking bolts.

2. An improved device as claimed in claim 1, wherein struts connect some of said wall sections to the steel plating of said ship.

3. An improved device as claimed in claim 1, wherein said wall sections are positioned in rows in the transverse direction of said ship with the plane of said wall sections positioned in parallel with the ship vertical longitudinal median plane.

4. An improved device according to claim 1, wherein each one of said wall sections comprises two end posts, cross bars interconnecting said end posts, each wall section formed at its upper as well as at its bottom with flanges, said four apertures formed in said flanges to receive said locking bolts.

5. An improved device as claimed in claim 1, wherein two openings are provided in each one of said wall sections above the centre of gravity of said wall sections, for introduction into said openings of the lifting legs of a fork lift truck, allowing said wall sections to be displaced in a vertical position by said fork lift truck to and from the places of erection of said wall sections.

* * * * *